US010801095B2

(12) United States Patent
Zhan et al.

(10) Patent No.: US 10,801,095 B2
(45) Date of Patent: Oct. 13, 2020

(54) ALUMINUM ALLOY AND METHOD OF MANUFACTURING

(71) Applicant: GM GLOBAL TECHNOLOGY OPERATIONS LLC, Detroit, MI (US)

(72) Inventors: Henry Zhan, Shanghai (CN); Bin Hu, Shanghai (CN)

(73) Assignee: GM Global Technology Operations LLC, Detroit, MI (US)

( * ) Notice: Subject to any disclaimer, the term of this patent is extended or adjusted under 35 U.S.C. 154(b) by 390 days.

(21) Appl. No.: 15/867,146

(22) Filed: Jan. 10, 2018

(65) Prior Publication Data

US 2019/0211431 A1 Jul. 11, 2019

(51) Int. Cl.

| | |
|---|---|
| ***C22C 21/02*** | (2006.01) |
| ***C22F 1/043*** | (2006.01) |
| ***C22C 21/04*** | (2006.01) |

(52) U.S. Cl.

CPC ..... *C22F 1/043* (2013.01); *C22C 21/04* (2013.01)

(58) Field of Classification Search

CPC ..... C22F 1/043; C22C 21/02

See application file for complete search history.

(56) References Cited

PUBLICATIONS

Mousa Javidani & Daniel Larouche; Application of cast Al—Si alloys in Internal combustion engine components; International Materials Reviews, 2014, vol. 59; No. 3, pp. 132-158.

Keith Robinson; The Structure of x(A1CrSi)—Cr4Si4A113; Crystallographic Laboratory, Cavendish Laboratory, Cambridge, England; Jun. 23, 1953; pp. 854-859.

Hai-Lin Chen, et al.; The isothermal section of the Al—Cr—Si system at 800 degreeC and the crystal structure of t2 (Cr3A19Si); Journal of Alloys and Compounds 436 (2007); pp. 313-318.

Marialaura Tocci et al.; Effect of Cr and Mn addition and heat treatment on AlSi3Mg casting alloy; Elsevier; Nov. 22, 2016; pp. 75-82.

Hyun You Kim et al.; The influence of Mn and Cr on the tensile properties of A356-0.20Fe alloy; Elsevier; Materials Letters 60 (2006); Dec. 12, 2005; pp. 1880-1883.

L. Lodgaard and N. Ryum; Precipitation of chromium containing dispersoids in Al—Mg—Si alloys; Materials Science and Technology, Jun. 2000, vol. 16; pp. 599-604.

*Primary Examiner* — Lois L Zheng

(74) *Attorney, Agent, or Firm* — Quinn IP Law

(57) ABSTRACT

An aluminum alloy for casting shaped aluminum alloy parts may comprise alloying elements of silicon and chromium and may be formulated to develop a dispersion strengthened and precipitation strengthened microstructure via heat treatment. The aluminum alloy may be formulated to develop a microstructure including an aluminum matrix phase and a fine-grained AlCrSi dispersoid phase when subjected to a solution heat treatment. The aluminum alloy also may be formulated to develop a microstructure including one or more Cu-containing precipitate phases when subjected to an aging heat treatment.

9 Claims, 6 Drawing Sheets

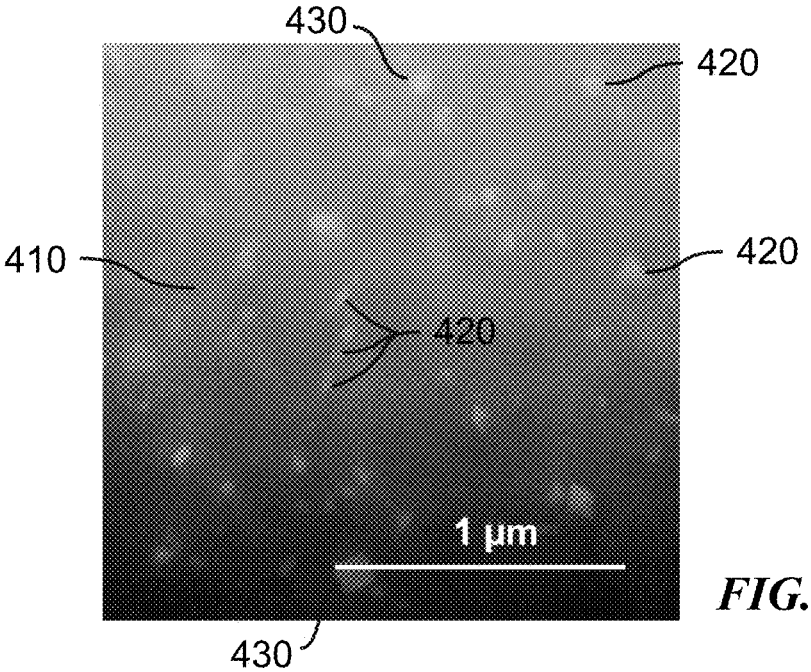
*FIG. 6*
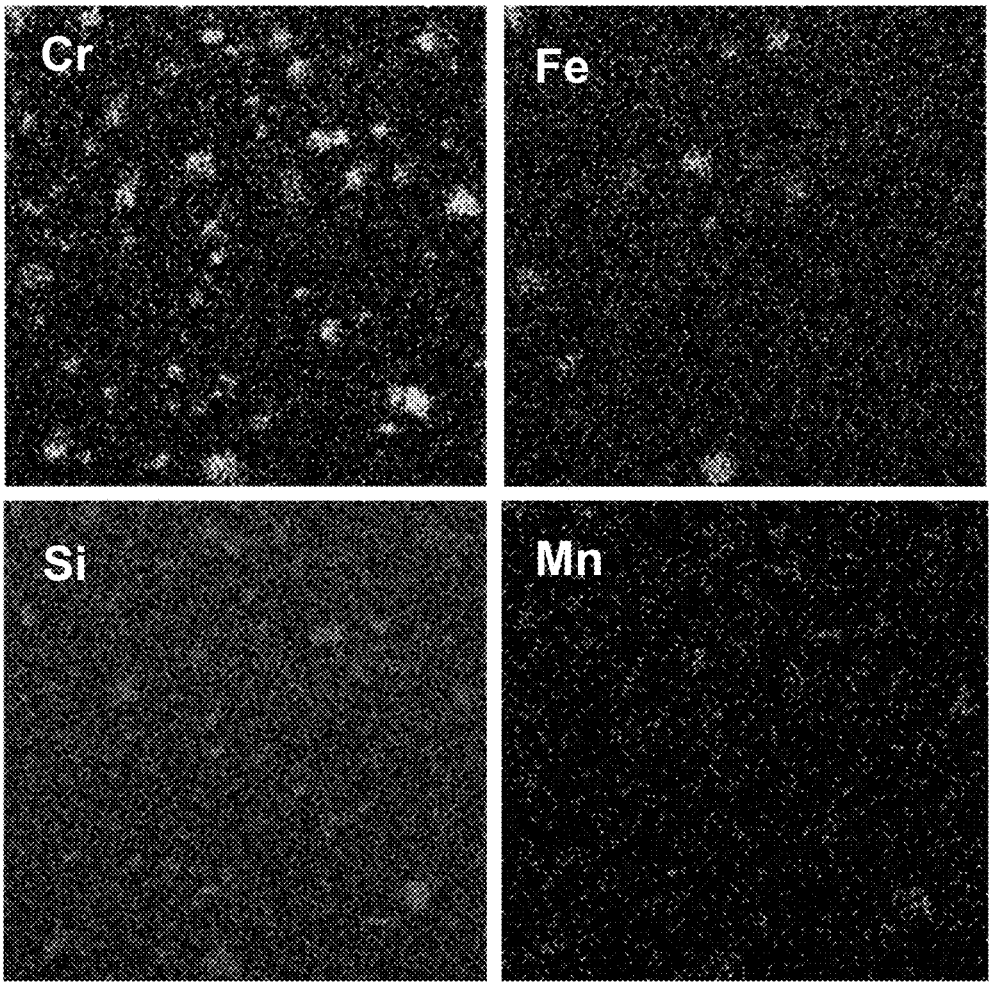

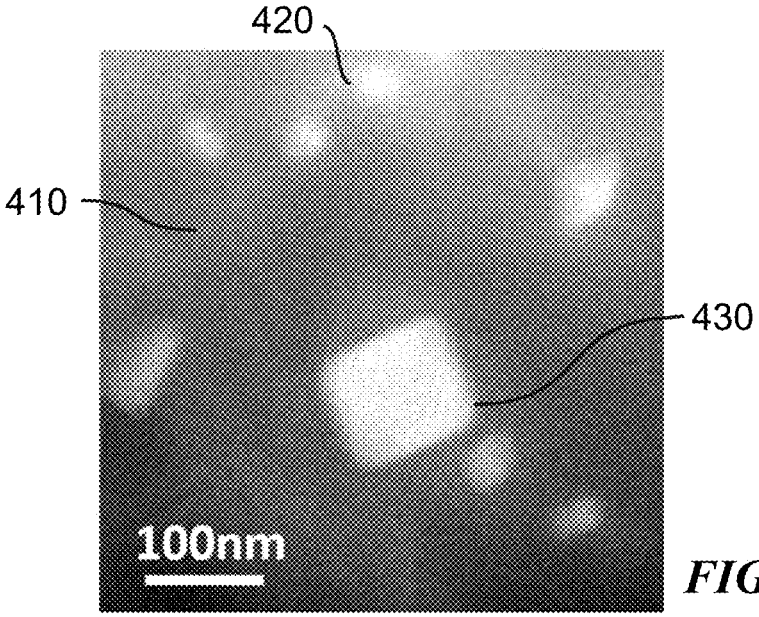
*FIG. 7*
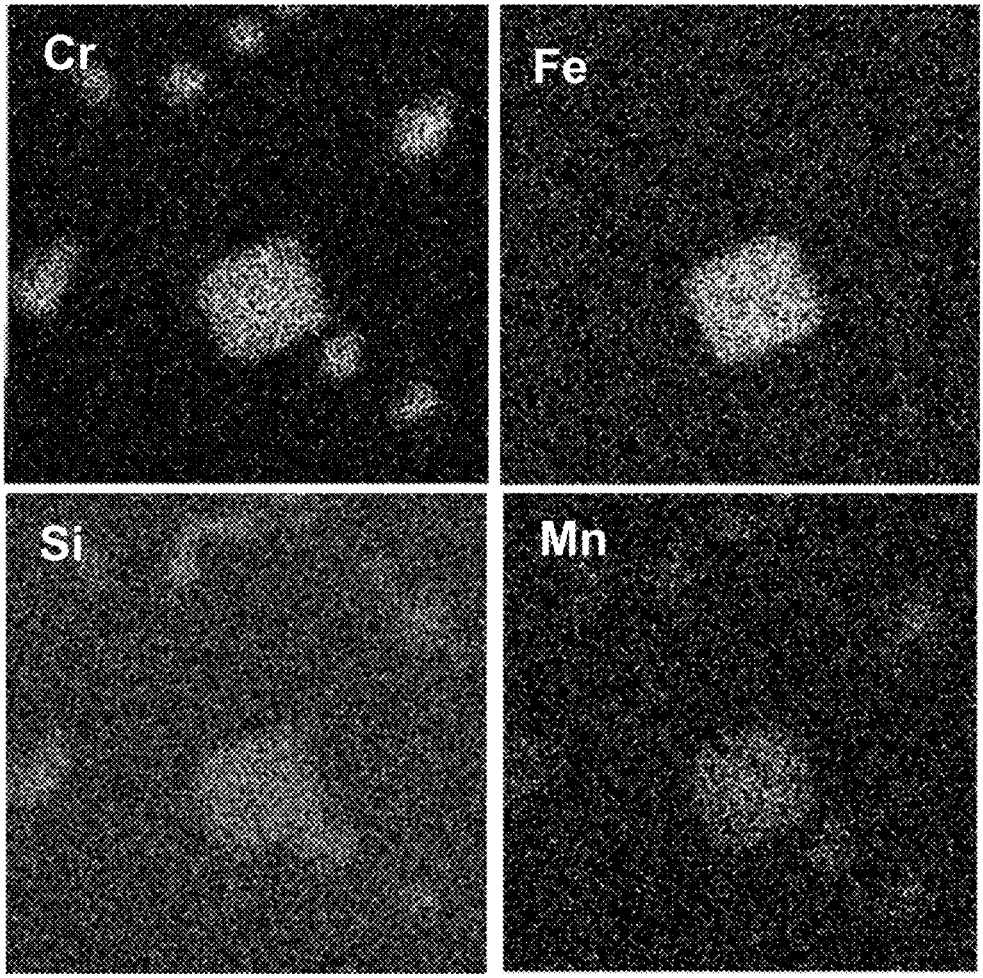

ALUMINUM ALLOY AND METHOD OF MANUFACTURING

INTRODUCTION

Aluminum exhibits a combination of high corrosion resistance, thermal conductivity, and machinability, and thus is a desirable material for use in the manufacture of vehicle components. Aluminum alloys for casting applications typically include silicon as an alloying element to provide the alloys with good castability and also may include alloying elements of copper, magnesium, and/or manganese so that the mechanical strength of the alloys can be increased after casting via heat treatment.

Heat treatment processes for cast aluminum alloys may include one or more of the following steps: (1) solution heat treatment, (2) rapid cooling or quenching, and (3) artificial aging. Solution heat treatment is typically performed at a relatively high temperature below the melting point of the alloy to dissolve certain alloying elements into solid solution and to homogenize the composition and microstructure of the alloy. After solution heat treatment, the alloy may be quenched into a cold or warm liquid medium to retain the dissolved alloying elements in a supersaturated solid solution. Artificial aging may be performed by heating the alloy to an intermediate temperature and holding the alloy at such temperature for a time sufficient to affect the precipitation of certain alloying elements from the supersaturated solid solution. The dissolution of alloying elements in an aluminum crystal lattice during solution heat treatment (solid solution strengthening) and/or the precipitation of a fine uniformly dispersed second phase within an aluminum matrix phase during aging (age hardening or precipitation strengthening) can effectively increase the mechanical strength and/or hardness of the aluminum alloy by "pinning" or impeding the movement of crystal defects referred to as dislocations within the alloy.

Precipitation strengthened aluminum alloys may experience a substantial reduction in mechanical strength at high temperatures due to coarsening of the precipitated second phase particles. Therefore, there is a need in the art for an aluminum alloy composition for casting applications that can develop a thermally stable precipitation strengthened microstructure via heat treatment.

SUMMARY

An aluminum alloy for casting shaped aluminum alloy parts may comprise, by weight, 3-11% silicon (Si), 0.1-0.6% chromium (Cr), ≤0.15% iron (Fe), and ≤0.3% manganese (Mn).

The aluminum alloy may comprise a weight ratio of chromium to iron and manganese, Cr:(Fe+Mn), of greater than or equal to 1:1.

After the aluminum alloy is solution heat treated, the aluminum alloy may exhibit a multiphase microstructure including an aluminum matrix phase and a fine-grained AlCrSi dispersoid phase. The AlCrSi dispersoid phase may exhibit a face centered cubic (fcc) crystal lattice structure and may comprise, by weight, greater than 80% Al, Cr, and Si.

The AlCrSi dispersoid phase and the aluminum matrix phase may exhibit a crystallographic orientation relationship between adjacent crystal grains. In such case, the crystallographic orientation relationship between the adjacent crystal grains may be at least one of $<001>_{Al}//<111>_{AlCrSi}$, $\{200\}_{Al}//\{4\bar{4}0\}_{AlCrSi}$ or $<001>_{Al}//<1\bar{1}0>_{AlCrSi}$, $\{200\}_{Al}//\{333\}_{AlCrSi}$.

The AlCrSi dispersoid phase may comprise a plurality of AlCrSi dispersoid grains distributed throughout the aluminum matrix phase. The AlCrSi dispersoid grains may have a mean grain diameter of less than or equal to 70 nm. The AlCrSi dispersoid phase may account for 0.3-2.0 vol. % of the aluminum alloy.

After the aluminum alloy is solution heat treated, the aluminum alloy also may exhibit a multiphase microstructure including an Al(Mn,Fe,Cr)Si dispersoid phase. The Al(Mn,Fe,Cr)Si dispersoid phase may account for less than 0.2 vol. % of the aluminum alloy.

The aluminum alloy also may comprise, by weight, 0.1-5% copper (Cu) and 0.1-1% magnesium (Mg). In such case, after the aluminum alloy is solution heat treated and artificially aged, the aluminum alloy may exhibit a multiphase microstructure including an aluminum matrix phase, a fine-grained AlCrSi dispersoid phase, and one or more Cu-containing precipitate phases. The one or more Cu-containing precipitate phases may include at least one of an AlCu precipitate phase and an AlCuMgSi precipitate phase.

In one form, the aluminum alloy may comprise, by weight, 5-9% silicon, 0.2-0.5% chromium, 0.3-1% copper, 0.3-0.5% magnesium, 0.05-0.2% titanium, 0.01-0.02% strontium, and aluminum as balance.

In a method of manufacturing an aluminum alloy exhibiting a dispersion strengthened and precipitation strengthened microstructure, an aluminum alloy may be provided. The aluminum alloy may include the following alloying elements in amounts by weight: 3-11% silicon (Si), 0.1-0.6% chromium (Cr), 0.1-5% copper (Cu), 0.1-1% magnesium (Mg), ≤0.15% iron (Fe), and ≤0.3% manganese (Mn). The aluminum alloy may be heated to a first temperature to at least partially dissolve one or more of the alloying elements into solid solution. The aluminum alloy may be cooled to a second temperature below the first temperature such that at least a portion of the alloying elements are retained in a supersaturated solid solution. After the aluminum alloy is cooled to the second temperature, the aluminum alloy may comprise an aluminum matrix phase and a fine-grained AlCrSi dispersoid phase. The aluminum alloy may be heated to a third temperature below the first temperature to precipitate one or more of the alloying elements from the aluminum matrix phase. Thereafter, the aluminum alloy may be cooled to a fourth temperature below the third temperature. After the aluminum alloy is cooled to the fourth temperature, the aluminum alloy may comprise the aluminum matrix phase, the AlCrSi dispersoid phase, and one or more Cu-containing precipitate phases.

The aluminum alloy may comprise a weight ratio of chromium to iron and manganese, Cr:(Fe+Mn), of greater than or equal to 1:1.

The AlCrSi dispersoid phase may have a face centered cubic (fcc) crystal lattice structure and may comprise, by weight, greater than 80% Al, Cr, and Si. The AlCrSi dispersoid phase and the aluminum matrix phase may exhibit a crystallographic orientation relationship between adjacent crystal grains.

In one form, the first temperature may comprise a temperature in the range of 500° C. to 540° C., and the aluminum alloy may be heated to the first temperature for a duration of 1 hour to 12 hours to at least partially dissolve one or more of the alloying elements into solid solution.

In another form, the first temperature may comprise a temperature in the range of 500° C. to 540° C., and the aluminum alloy may be heated to a fifth temperature in the range of 150° C. to less than 500° C. for a duration of 1 hour to 10 hours prior to heating the aluminum alloy to the first temperature for a duration of 0.5 hours to 4 hours.

The third temperature may comprise a temperature in the range of 150° C. to 250° C., and the aluminum alloy may be heated to the third temperature for a duration of 1 hour to 10 hours to precipitate one or more of the alloying elements from the aluminum matrix phase.

The AlCrSi dispersoid phase may comprise a plurality of AlCrSi dispersoid grains distributed throughout the aluminum matrix phase. After the aluminum alloy is cooled to the fourth temperature, the AlCrSi dispersoid grains may have a mean grain diameter of less than or equal to 70 nm.

The AlCrSi dispersoid phase may not exhibit coarsening when heated at temperatures in the range of 200° C. to 300° C. for 100 hours.

Prior to heating the aluminum alloy to the first temperature, the aluminum alloy may be cast into a shaped aluminum alloy part via a sand casting, permanent mold casting, low-pressure die casting, vacuum-assisted high-pressure die casting, squeeze casting, or semi-solid metal casting process.

In one form, the aluminum alloy may be cast into the shape of a cylinder head for an internal combustion engine.

BRIEF DESCRIPTION OF THE DRAWINGS

FIG. 6 illustrates a scanning transmission electron microscopy (STEM) image of a portion of a solution heat treated Al—Si—Cr—Mg alloy, including an aluminum matrix phase, an AlCrSi dispersoid phase, and an Al(Mn,Fe,Cr)Si dispersoid phase, with energy-dispersive x-ray (EDX) maps of Cr, Si, Fe, and Mn;

FIG. 7 is an enlarged STEM image of a portion of the Al—Si—Cr—Mg alloy of FIG. 6, with EDX maps of Cr, Si, Fe, and Mn;

DETAILED DESCRIPTION

Figure 1:
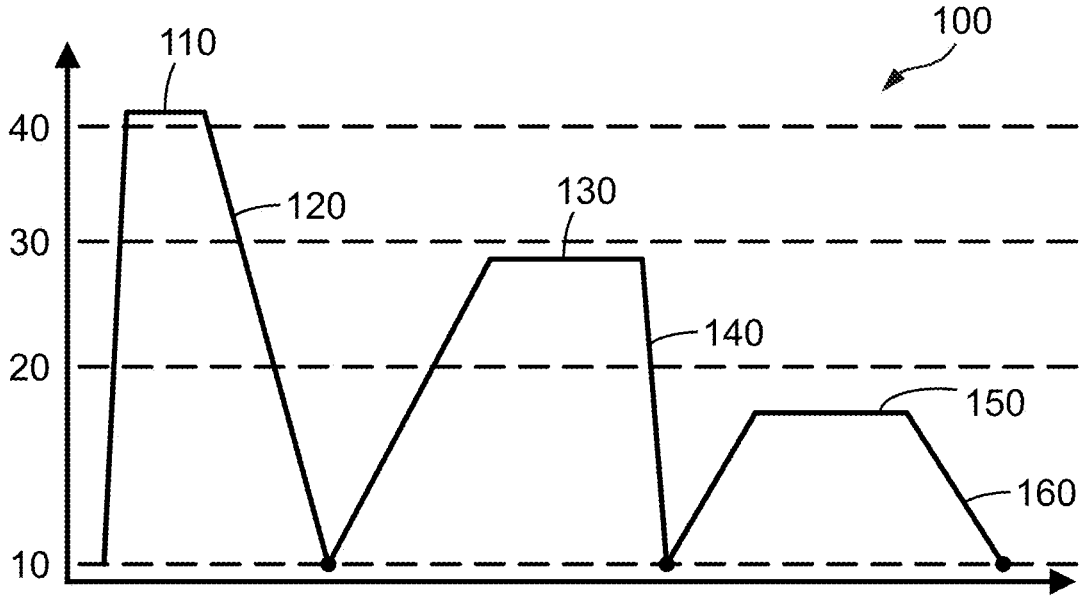
FIG. 1 is a schematic graph of Temperature vs. Time illustrating a multistage heat treatment process for manufacturing an Al—Si—Cr—Cu—Mg alloy having a dispersion strengthened and precipitation strengthened microstructure, in accordance with one aspect of the present disclosure.

The presently disclosed aluminum alloy can be used to manufacture shaped aluminum alloy parts via a variety of casting processes, e.g., sand casting, permanent mold casting, low-pressure die casting, vacuum-assisted high-pressure die casting, squeeze casting, and semi-solid metal casting, to name a few. The aluminum alloy is formulated to achieve a dispersion strengthened and precipitation strengthened microstructure exhibiting high mechanical strength both at ambient temperature (e.g., 25° C.) and at elevated temperatures (e.g., up to about 550° C.) when subjected to a suitable heat treatment process. As such, the aluminum alloy may suitably be used in the manufacture of various internal combustion engine components, e.g., cylinder heads, cylinder liners, pistons, and exhaust components.

As used herein, the term "aluminum alloy" refers to a material that comprises, by weight, greater than or equal to 80% or, more preferably, greater than or equal to 90% aluminum (Al) and one or more other elements selected to impart certain desirable properties to the material that are not exhibited by pure aluminum.

An aluminum alloy composition for casting shaped aluminum alloy parts may comprise, in addition to aluminum, alloying elements of silicon (Si), chromium (Cr), copper (Cu), and magnesium (Mg), and thus may be referred to herein as an Al—Si—Cr—Cu—Mg alloy. For example, the Al—Si—Cr—Cu—Mg alloy may comprise, by weight, greater than or equal to 3% or5% silicon; less than or equal to 11% or 9% silicon; or between 3-11% or 5-9% silicon. The Al—Si—Cr—Cu—Mg alloy may comprise, by weight, greater than or equal to 0.1% or 0.2% chromium; less than or equal to 0.6% or 0.5% chromium; or between 0.1-0.6% or 0.2-0.5% chromium. The Al—Si—Cr—Cu—Mg alloy may comprise, by weight, greater than or equal to 0.1% or 0.3% copper; less than or equal to 5% or 1% copper; or between 0.1-5% or 0.3-1% copper. The Al—Si—Cr—Cu—Mg alloy may comprise, by weight, greater than or equal to 0.1% or 0.3% magnesium; less than or equal to 1% or 0.5% magnesium; or between 0.1-1% or 0.3-0.5% magnesium.

The respective amounts of Si, Cr, Cu, and Mg in the Al—Si—Cr—Cu—Mg alloy are selected to provide the alloy with certain desirable properties during casting and with the ability to develop a desired microstructure during a subsequent heat treatment process. For example, the amount of silicon in the Al—Si—Cr—Cu—Mg alloy is selected to provide the molten alloy with suitable fluidity for casting, a relatively low melting temperature, excellent dimensional stability, and low thermal expansion. In addition, the respective amounts of Si, Cr, Cu, and Mg in the Al—Si—Cr—Cu—Mg alloy are selected to provide the alloy with the ability to develop a multiphase microstructure including a face centered cubic (fcc) aluminum matrix phase, a fine-grained dispersoid phase, and one or more precipitate phases when subjected to a suitable heat treatment process that includes a solution heat treatment stage and a subsequent artificial aging heat treatment stage. The aluminum matrix phase is aluminum-based and may not comprise 100% aluminum; instead, the aluminum matrix phase may comprise a solid solution having one or more alloying elements substitutionally and/or interstitially incorporated into an aluminum crystal lattice. The aluminum matrix phase may have lattice parameters (a, b, c) in the range of 0.4-0.41 nm, or about 0.405 nm.

The amount of chromium in the Al—Si—Cr—Cu—Mg alloy is selected to provide the alloy with the ability to develop a thermally stable Al-, Cr-, and Si-based dispersoid (referred to herein as an "AlCrSi dispersoid") phase within the aluminum matrix phase when subjected to a suitable solution heat treatment. The AlCrSi dispersoid phase may have an fcc crystal lattice structure with lattice parameters (a, b, c) in the range of 1.07-1.20 nm, or about 1.093 nm. In addition, the AlCrSi dispersoid phase may comprise a plurality of nanometer-sized AlCrSi dispersoids distributed throughout the aluminum matrix phase. The AlCrSi dispersoid phase is "Al-, Cr-, and Si-based," meaning that the AlCrSi dispersoid phase primarily comprises the elements Al, Cr, and Si, but also may comprise one or more other elements, e.g., Fe and/or Mn, in relatively small amounts. For example, the combined amounts of Al, Cr, and Si in the AlCrSi dispersoid phase may comprise, by weight, greater than 80%, greater than 90%, or more preferably greater than 95% of the AlCrSi dispersoid phase. In one form, the AlCrSi dispersoid phase may have a nominal composition represented by the following empirical formula: $Al_{13}Cr_4Si_4$. For example, the AlCrSi dispersoid phase may comprise, by weight, 50-60% Al, 25-35% Cr, and 10-20% Si. In addition, the AlCrSi dispersoid phase preferably comprises, by weight, less than 15% (Fe+Mn) or, more preferably, less than 10% (Fe+Mn).

Formation of the AlCrSi dispersoid phase within the aluminum matrix phase has been found to improve the overall strength of the Al—Si—Cr—Cu—Mg alloy at elevated temperatures. Without intending to be bound by theory, it is believed that the high temperature strength imparted to the Al—Si—Cr—Cu—Mg alloy by the AlCrSi dispersoid phase may be attributed, at least in part, to the relatively low solid solubility and relatively low diffusivity of chromium in the aluminum matrix phase at elevated temperatures (as compared to those of, e.g., Mn, Fe, and Cu), as well as the crystallographic orientation relationship between the AlCrSi dispersoid phase and the aluminum matrix phase. It is believed that crystal grains of the aluminum matrix phase and crystal grains of the AlCrSi dispersoid phase will both exhibit fcc crystal lattice structures and also will exhibit minimal mismatch between certain specific pairs of lattice planes. In other words, the AlCrSi dispersoid phase and the aluminum matrix phase may exhibit one or more crystallographic orientation relationships between adjacent crystal grains. In particular, the AlCrSi dispersoid phase and the aluminum matrix phase may exhibit the following crystallographic orientation relationship: $\langle 001\rangle_{Al}//\langle 111\rangle_{AlCrSi}$, $\{200\}_{Al}//\{4\bar{4}0\}_{AlCrSi}$. In addition, the AlCrSi dispersoid phase and the aluminum matrix phase may exhibit the following crystallographic orientation relationship: $\langle 001\rangle_{Al}\langle 1\bar{1}0\rangle_{AlCrSi}$, $\{200\}_{Al}//\{333\}_{AlCrSi}$. The interatomic spacing misfit along matching rows and the interplanar spacing mismatch between matching planes of the aluminum matrix phase and the AlCrSi dispersoid phase each may be less than 5%. In particular, the misfit between the spacing of the {002} atomic lattice planes of the aluminum matrix phase and the {333} atomic lattice planes of the AlCrSi dispersoid phase may be less than 4%, for example, about 3.6%. In addition, the misfit between the spacing of the {002} atomic lattice planes of the aluminum matrix phase and the $\{4\bar{4}0\}$ atomic lattice planes of the AlCrSi dispersoid phase may be less than 5%, for example, about 4.8%.

In turn, it is believed that the crystallographic relationships between the aluminum matrix phase and the AlCrSi dispersoid phase will lead to matching of atomic positions at the dispersoid-matrix interface, coherency or semi-coherency between the aluminum matrix phase and the AlCrSi dispersoid phase, and relatively low interfacial energy at the interfaces between the aluminum matrix phase and the AlCrSi dispersoid phase. As a result, it is believed that the AlCrSi dispersoid phase will exhibit exceptional thermal stability and resistance to coarsening (i.e., resistance to grain growth) at elevated temperatures, thereby imparting high mechanical strength to the Al—Si—Cr—Cu—Mg alloy and to cast aluminum alloy parts formed therefrom, both at ambient temperature and at elevated temperatures. For example, the AlCrSi dispersoid phase may exhibit resistance to coarsening at ambient temperature and at elevated temperatures and the AlCrSi dispersoid grains may not increase in volume by more than 20% when exposed to temperatures in the range of 200° C. to 300° C. for 100 hours. In addition, the AlCrSi dispersoid grains may not increase in volume by more than 20% when exposed to temperatures up to 550° C. for less than 1 hour.

The amounts of iron (Fe) and manganese (Mn) in the Al—Si—Cr—Cu—Mg alloy are controlled so that formation of the fcc AlCrSi dispersoid phase within the aluminum matrix phase is favored over the formation of one or more other dispersoid phases. For example, the combined amount of iron and manganese relative to the amount of chromium in the Al—Si—Cr—Cu—Mg alloy may be controlled so that formation of the AlCrSi dispersoid phase is favored over the formation of an Al-, Mn-, Fe-, Cr-, and Si-based dispersoid (referred to herein as an "Al(Mn,Fe,Cr)Si dispersoid") phase. The Al(Mn,Fe,Cr)Si dispersoid phase may have a body centered cubic (bcc) crystal lattice structure with lattice parameters (a, b, c) in the range of 1.2-1.3 nm, or about 1.256 nm. The Al(Mn,Fe,Cr)Si dispersoid phase is "Al-, Mn-, Fe-, Cr-, and Si-based," meaning that the Al(Mn,Fe,Cr)Si dispersoid phase primarily comprises the elements Al, Mn, Fe, Cr, and Si. For example, the combined amounts of Al, Mn, Fe, Cr, and Si in the Al(Mn,Fe,Cr)Si dispersoid phase may comprise, by weight, greater than 90% of the Al(Mn,Fe,Cr)Si dispersoid phase. In addition, the Al(Mn,Fe,Cr)Si dispersoid phase may comprise, by weight, greater than 15% (Mn+Fe), or greater than 20% (Mn+Fe).

As compared to the fcc AlCrSi dispersoid phase, formation of the Al(Mn,Fe,Cr)Si dispersoid phase within the aluminum matrix phase is less desirable because the bcc Al(Mn,Fe,Cr)Si dispersoid phase exhibits relatively poor thermal stability at elevated temperatures. Without intending to be bound by theory, it is believed that the poor thermal stability of the Al(Mn,Fe,Cr)Si dispersoid phase may be attributed, at least in part, to the relatively high solid solubility of Mn and the relatively high diffusivity of Mn and Fe in the aluminum matrix phase, as compared to the solid solubility and diffusivity of Cr. As such, the Al(Mn,Fe,Cr)Si dispersoid phase may be more susceptible to coarsening at elevated temperatures and may be incoherent with the aluminum matrix phase, which will effectively reduce the Al(Mn,Fe,Cr)Si dispersoid phase's ability to contribute to the mechanical strength of the Al—Si—Cr—Cu—Mg alloy at such temperatures.

To ensure that the AlCrSi dispersoid phase is the dominant dispersoid phase within the aluminum matrix phase, it has been found that a weight ratio of chromium to iron and manganese, Cr:(Fe+Mn), in the Al—Si—Cr—Cu—Mg alloy of greater than 1:1 or, more preferably, greater than 2:1 is preferred. For example, the weight ratio of Cr:(Fe+Mn) in the Al—Si—Cr—Cu—Mg alloy may be greater than or equal to 1:1 or 2:1; less than or equal to 10:1 or 5:1; or between 1:1 and 10:1 or between 2:1 and 5:1. To achieve a suitable Cr:(Fe+Mn) ratio, in some embodiments, the Al—Si—Cr—Cu—Mg alloy may be essentially free of iron (Fe) and may comprise, by weight, less than 0.15% Fe, or more preferably less than or equal to 0.12% Fe. Additionally or alternatively, the Al—Si—Cr—Cu—Mg alloy may be essentially free of manganese (Mn) and may comprise, by weight, less than 0.3%, Mn, or more preferably less than or equal to 0.15% Mn.

The term "dominant," as used herein in reference to the AlCrSi dispersoid phase, may mean that the AlCrSi dispersoid phase (i) accounts for the largest number of discrete dispersoids in the Al—Si—Cr—Cu—Mg alloy, (ii) represents the largest dispersoid phase in the Al—Si—Cr—Cu—Mg alloy by volume, and/or (iii) represents the largest dispersoid phase in the Al—Si—Cr—Cu—Mg alloy by weight. For example, the number of discrete AlCrSi dispersoids in the Al—Si—Cr—Cu—Mg alloy may be greater than the number of discrete Al(Mn,Fe,Cr)Si dispersoids in the Al—Si—Cr—Cu—Mg alloy. Additionally or alternatively, the volume and/or mass fraction of the AlCrSi dispersoid phase in the Al—Si—Cr—Cu—Mg alloy may be greater than that of the Al(Mn,Fe,Cr)Si dispersoid phase.

The inclusion of chromium in aluminum alloys for casting applications was previously believed to be undesirable due to the increased probability of sludge formation. However, chromium advantageously may be included in the presently disclosed Al—Si—Cr—Cu—Mg alloy without resulting in the formation of sludge by controlling the amount of chromium, iron, and manganese in the Al—Si—Cr—Cu—Mg alloy. In particular, the formation of sludge in the Al—Si—Cr—Cu—Mg alloy may be avoided by controlling the amounts of chromium, iron, and manganese in the Al—Si—Cr—Cu—Mg alloy so that the alloy exhibits a sludge factor (SF), calculated as SF=(1×wt % Fe)+(2×wt % Mn)+(3×wt % Cr), of less than 2 wt % or, more preferably, less than 1.8 wt %.

The amount of copper in the Al—Si—Cr—Cu—Mg alloy is selected to provide the alloy with the ability to develop one or more Cu-containing precipitate phases within the aluminum matrix phase when subjected to a suitable aging heat treatment. For example, the amount of copper in the Al—Si—Cr—Cu—Mg alloy may be selected to provide the alloy with the ability to develop a thermally stable Al- and Cu-based precipitate (referred to herein as an "AlCu precipitate") phase within the aluminum matrix phase when subjected to a suitable aging heat treatment. The AlCu precipitate phase may have a tetragonal crystal lattice structure and may comprise a plurality of nanometer-sized plate-like precipitates distributed throughout the aluminum matrix phase. The AlCu precipitate phase is "Al- and Cu-based," meaning that the AlCu precipitate phase primarily comprises Al and Cu. For example, the combined amounts of Al and Cu in the AlCu precipitate phase may represent, by weight, greater than 90% of the AlCu precipitate phase. Formation of the AlCu precipitate phase within the aluminum matrix phase may provide the Al—Si—Cr—Cu—Mg alloy with high strength at relatively low temperatures, e.g., at ambient temperature.

The total and respective amounts of copper and magnesium in the Al—Si—Cr—Cu—Mg alloy are selected to provide the alloy with the ability to develop an Al-, Cu-, Mg-, and Si-based precipitate (referred to herein as an "AlCuMgSi precipitate") phase within the aluminum matrix phase when subjected to a suitable aging heat treatment. The AlCuMgSi precipitate phase may comprise a plurality of nanometer-sized AlCuMgSi precipitates distributed throughout the aluminum matrix phase. The AlCuMgSi precipitate phase is "Al-, Cu-, Mg-, and Si-based," meaning that the AlCuMgSi precipitate phase primarily comprises Al, Cu, Mg, and Si. For example, the combined amounts of Al, Cu, Mg, and Si in the AlCuMgSi precipitate phase may represent, by weight, greater than 90% of the AlCuMgSi precipitate phase. Formation of the AlCuMgSi precipitate phase within the aluminum matrix phase may provide the Al—Si—Cr—Cu—Mg alloy with high strength at ambient temperature and at elevated temperatures.

The relative amounts of copper and magnesium in the Al—Si—Cr—Cu—Mg alloy may be controlled to optimize the respective amounts of the AlCu and AlCuMgSi precipitate phases formed in the alloy during aging. In one form, the relative amounts of copper and magnesium in the Al—Si—Cr—Cu—Mg alloy may be controlled so that the weight ratio of copper to magnesium, Cu:Mg, in the Al—Si—Cr—Cu—Mg alloy is greater than 1:1.

The Al—Si—Cr—Cu—Mg alloy optionally may comprise alloying elements of titanium (Ti) and/or strontium (Sr). For example, the Al—Si—Cr—Cu—Mg alloy may comprise, by weight, 0.05-0.2% titanium. Additionally or alternatively, the Al—Si—Cr—Cu—Mg alloy may comprise, by weight, 100 ppm to 200 ppm strontium.

Additional elements not intentionally introduced into the composition of the Al—Si—Cr—Cu—Mg alloy nonetheless may be inherently present in the alloy in relatively small amounts, for example, less than 0.2%, preferably less than 0.05%, and more preferably less than 0.01% by weight of the Al—Si—Cr—Cu—Mg alloy. Such elements may be present, for example, as impurities in the raw materials used to prepare the Al—Si—Cr—Cu—Mg alloy composition. In embodiments were the Al—Si—Cr—Cu—Mg alloy is referred to as comprising one or more alloying elements (e.g., one or more of Si, Cr, Cu, Mg, Ti, and Sr) and aluminum as balance, the term "as balance" does not exclude the presence of additional elements not intentionally introduced into the composition of the Al—Si—Cr—Cu—Mg alloy but nonetheless inherently present in the alloy in relatively small amounts, e.g., as impurities.

After the Al—Si—Cr—Cu—Mg alloy has been heat treated to include desired amounts of the AlCrSi dispersoid, AlCu precipitate, and AlCuMgSi precipitate phases, the Al—Si—Cr—Cu—Mg alloy will exhibit high mechanical strength both at ambient temperature and at elevated temperatures. The thermal stability of the heat-treated Al—Si—Cr—Cu—Mg alloy may depend upon the specific elevated temperature at which the alloy is heated and the duration of exposure. For example, after the Al—Si—Cr—Cu—Mg alloy has been subjected to a suitable heat treatment process, the Al—Si—Cr—Cu—Mg alloy may exhibit excellent thermal stability at elevated temperatures up to about 550° C. for durations of less than 1 hour. In addition, after the Al—Si—Cr—Cu—Mg alloy has been subjected to a suitable heat treatment process, the Al—Si—Cr—Cu—Mg alloy may exhibit excellent thermal stability at elevated temperatures up to about 300° C. for durations equal to or greater than 100 hours.

FIG. 1 depicts a graph of processing temperature versus time for a multistage heat treatment process 100 that can be used to produce an Al—Si—Cr—Cu—Mg alloy exhibiting a dispersion strengthened and precipitation strengthened microstructure, according to one or more embodiments of the present disclosure. The heat treatment process 100 may include one or more of the following stages: a casting stage 110, a first cooling stage 120, a solution heat treatment stage 130, a quenching stage 140, an aging heat treatment stage 150, and a second cooling stage 160. For reference, dashed lines are drawn from the vertical temperature axis illustrating ambient temperature $T_A$(10), the solvus temperature $T_V$ of at least one intermetallic precipitate phase in the Al—Si—Cr—Cu—Mg alloy (20), the solidus temperature $T_S$ of the Al—Si—Cr—Cu—Mg alloy (30), and the liquidus temperature $T_L$ of the Al—Si—Cr—Cu—Mg alloy (40). The solvus $T_V$, solidus $T_S$, and liquidus $T_L$ temperatures may vary depending on the specific chemical composition of the Al—Si—Cr—Cu—Mg alloy and the intermetallic precipitate phase(s) contained therein.

During the casting stage 110, a volume of molten Al—Si—Cr—Cu—Mg alloy is prepared, for example, by mixing together all constituents of the Al—Si—Cr—Cu—Mg alloy in corresponding amounts, and then heating the mixture to a first temperature T1 above the liquidus temperature $T_L$ of the Al—Si—Cr—Cu—Mg alloy. While the Al—Si—Cr—Cu—Mg alloy is in molten form, the alloy may be cast into a desired shape, for example, by being introduced into a mold. Thereafter, in the first cooling stage 120, the Al—Si—Cr—Cu—Mg alloy is cooled down to ambient temperature $T_A$ or to an intermediate temperature, e.g., less than 100° C. The rate at which the Al—Si—Cr—Cu—Mg alloy is cooled down during the first cooling stage 120 may be gradual or rapid and may depend upon the method of casting.

Figure 3:
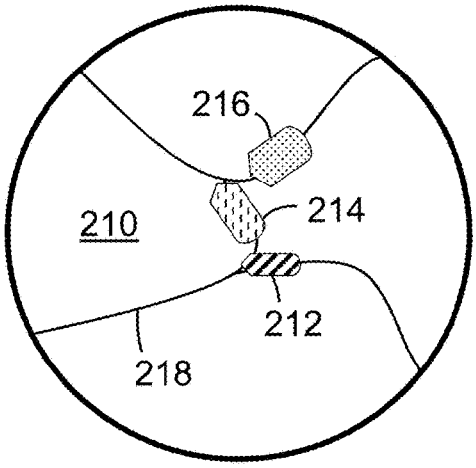
FIG. 3 is a schematic illustration of the microstructure of an Al—Si—Cr—Cu—Mg alloy that has been cast into a desired shape without being subjected to a subsequent heat treatment process, the microstructure of the Al—Si—Cr—Cu—Mg alloy includes an aluminum matrix phase and a plurality of coarse intermetallic (constituent) phases.

FIG. 3 is a schematic illustration of the microstructure of an Al—Si—Cr—Cu—Mg alloy that has been cast into a desired shape via a casting process (stage 110) and cooled down to ambient temperature $T_A$ or to an intermediate temperature (stage 120). The microstructure of the Al—Si—Cr—Cu—Mg alloy depicted in FIG. 3 is shown as if the alloy were being viewed along the $[001]_{Al}$ zone axis and may or may not be to scale. Without intending to be bound by theory, it is believed that, during the casting and cooling stages 110, 120, solidification of the molten Al—Si—Cr—Cu—Mg alloy may begin with the formation of a primary Al-based dendritic network, leading to an increase in the solute concentration of the remaining molten alloy material. At the same time or shortly thereafter, an Al- and Si-containing eutectic mixture (Al—Si eutectic) may solidify among the growing Al-based dendrite grains, leading to further solute enrichment of the remaining molten alloy material. This solute-enriched molten alloy material may solidify in the form of coarse intermetallic compounds in isolated regions between growing grains (intergranular regions) and within grain envelopes (interdendritic regions) established by the Al-based dendrite grains and the Al—Si eutectic grains.

For example, as shown in FIG. 3, after the Al—Si—Cr—Cu—Mg alloy is cooled in stage 120, the alloy may comprise a continuous aluminum matrix phase 210 and a plurality of coarse intermetallic phases 212, 214, 216 distributed throughout the aluminum matrix phase 210. Although not specifically depicted in FIG. 3, after the Al—Si—Cr—Cu—Mg alloy is cooled in stage 120, the alloy will generally also comprise an Al—Si eutectic phase. In addition, the intermetallic phases 212, 214, 216 are depicted in FIG. 3 as being distributed along grain boundaries 218 within the aluminum matrix phase 210; however, in practice this may or may not be the case. The coarse intermetallic phases 212, 214, 216 may be enriched with one or more alloying elements, e.g., Si, Cr, Cu, and/or Mg. For example, as shown in FIG. 3, the coarse intermetallic phases may comprise a Cr-rich intermetallic phase 212, an Mg-rich intermetallic phase 214, and a Cu-rich intermetallic phase 216. The aluminum matrix phase 210 may comprise Al-based grains having mean grain diameters in the range of 200 μm to 1000 μm, and the intermetallic phases 212, 214, 216 may comprise crystalline grains having mean grain diameters in the range of 2 μm to 20 μm. Without intending to be bound by theory, it is believed that, due to the relatively low diffusivity and solid solubility of Cr in Al, as well as the rate at which the Al—Si—Cr—Cu—Mg alloy is cooled in stage 120, the aluminum matrix phase 210 also may comprise an Al-based solid solution supersaturated with Cr.

In stage 130, the Al—Si—Cr—Cu—Mg alloy is subjected to a solution heat treatment by being heated to a second temperature T2 below the solidus temperature $T_S$ of the Al—Si—Cr—Cu—Mg alloy, but above the solvus temperature $T_V$ of one or more of the intermetallic phases 212, 214, 216. The Al—Si—Cr—Cu—Mg alloy may be held at the second temperature T2 for a time sufficient to dissolve into solid solution one or more of the intermetallic phases 212, 214, 216 that may have formed during the first cooling stage 120. In addition, the Al—Si—Cr—Cu—Mg alloy may be held at the second temperature T2 for a time sufficient for a plurality of fine-grained AlCrSi dispersoids to precipitate from the aluminum matrix phase 210. For example, the Al—Si—Cr—Cu—Mg alloy suitably may be heated in stage 130 to a second temperature T2 in the range of 500° C. to 540° C. for 1-12 hours. In one specific example, the Al—Si—Cr—Cu—Mg alloy may be heated in stage 130 to a second temperature T2 in the range of 530° C. to 540° C. for 5-8 hours. The degree of dissolution of the intermetallic phases 212, 214, 216 in the aluminum matrix phase 210 will depend, at least in part, on the temperature at which the Al—Si—Cr—Cu—Mg alloy is heated, the size of the intermetallic phases 212, 214, 216, the specific alloying elements contained therein, and on the diffusivity and solid solubility of the alloying elements in the aluminum matrix phase 210.

In stage 140, the Al—Si—Cr—Cu—Mg alloy is rapidly cooled or quenched from the second temperature T2 to ambient temperature $T_A$ or to an intermediate temperature, e.g., less than 100° C., at a cooling rate sufficient to prevent diffusion and precipitation of dissolved alloying elements and to retain at least a portion of the alloying elements (e.g., Cr, Mg, Si, and/or Cu) in a supersaturated solid solution in the aluminum matrix phase 210. For example, the Al—Si—Cr—Cu—Mg alloy may be quenched in stage 140 at a rate of greater than 1° C. per second by immersing the Al—Si—Cr—Cu—Mg alloy in a liquid medium, e.g., in water or oil.

Figure 4:
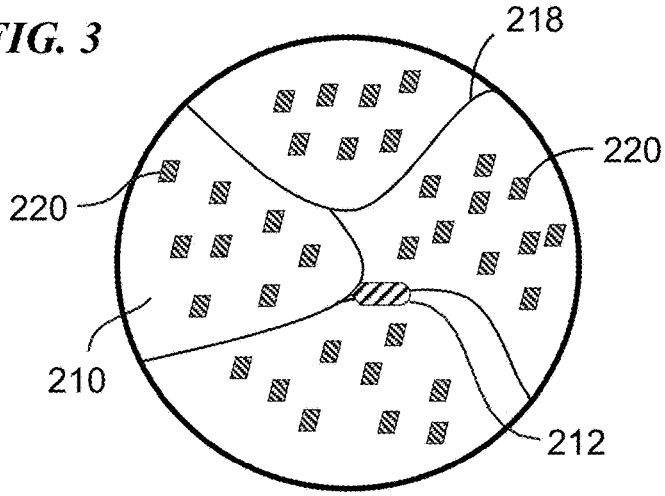
FIG. 4 is a schematic illustration of the microstructure of an Al—Si—Cr—Cu—Mg alloy that has been subjected to a heat treatment process, including a solution heat treatment stage and a quenching stage, the microstructure of the Al—Si—Cr—Cu—Mg alloy includes an aluminum matrix phase and an AlCrSi dispersoid phase.

FIG. 4 is a schematic illustration of the microstructure of the Al—Si—Cr—Cu—Mg alloy after the Al—Si—Cr—Cu—Mg alloy has been quenched in stage 140. The microstructure of the Al—Si—Cr—Cu—Mg alloy depicted in FIG. 4 is shown as if the alloy were being viewed along the $[001]_{Al}$ zone axis and may or may not be to scale. The morphology of the Al—Si—Cr—Cu—Mg alloy may appear somewhat different than that depicted in FIG. 4, for example, if the alloy were to be viewed along a different axis. As shown in FIG. 4, after the Al—Si—Cr—Cu—Mg alloy is quenched in stage 140, the alloy will comprise an aluminum matrix phase 210 and an AlCrSi dispersoid phase 220 including a plurality of fine-grained AlCrSi dispersoids distributed throughout the aluminum matrix phase 210. In some embodiments, one or more Cr-rich intermetallic phases 212 also may remain within the matrix phase 210. Without intending to be bound by theory, it is believed that the relatively low solid solubility of Cr in Al and the relatively high temperature of the solution heat treatment stage 130 (despite the relatively low diffusivity of Cr in Al) may be responsible for the formation of the AlCrSi dispersoid phase 220 within the matrix phase 210 and also may be responsible for preventing dissolution of the Cr-rich intermetallic phases 212 in the matrix phase 210. The AlCrSi dispersoid grains may have grain diameters in the range of 20-100 nm and/or may have a mean grain diameter of less than or equal to 70 nm, or more preferably less than or equal to 50 nm. After the Al—Si—Cr—Cu—Mg alloy is quenched in stage 140, the AlCrSi dispersoid phase 220 may account for 0.3 vol. % to 2.0 vol. % of the Al—Si—Cr—Cu—Mg alloy. In some embodiments, after the Al—Si—Cr—Cu—Mg alloy is quenched in stage 140, the Al—Si—Cr—Cu—Mg alloy also may comprise a Al(Mn,Fe,Cr)Si dispersoid phase (not shown) including a plurality of Al(Mn,Fe,Cr)Si dispersoids distributed throughout the aluminum matrix phase 210. In such case, the Al(Mn,Fe,Cr)Si dispersoid phase may account for less than 0.2 vol. % of the Al—Si—Cr—Cu—Mg alloy.

In stage 150, the Al—Si—Cr—Cu—Mg alloy is subjected to an artificial aging heat treatment by being heated to a third temperature T3 above ambient temperature $T_A$ but below the solvus temperature $T_V$ of the intermetallic phases 212, 214, 216 and below the solidus temperature $T_S$ of the Al—Si—Cr—Cu—Mg alloy. The Al—Si—Cr—Cu—Mg alloy may be held at the third temperature T3 for a time sufficient to form one or more precipitate phases in the aluminum matrix phase 210. For example, the Al—Si—Cr—Cu—Mg alloy suitably may be heated in stage 150 to a third temperature T3 in the range of 150° C. to 250° C. for 1-10 hours. In one specific example, the Al—Si—Cr—Cu—Mg alloy may be heated in stage 150 to a third temperature T3 in the range of 175° C. to 200° C. for 5-8 hours. The specific temperature and time at which the Al—Si—Cr—Cu—Mg alloy is heated in stage 150 will depend upon the desired ductility and strength of the resulting Al—Si—Cr—Cu—Mg alloy. In stage 160, the Al—Si—Cr—Cu—Mg alloy may be gradually cooled from the third temperature T3 to ambient temperature $T_A$ or to an intermediate temperature, e.g., less than 100° C., by any suitable method.

Figure 5:
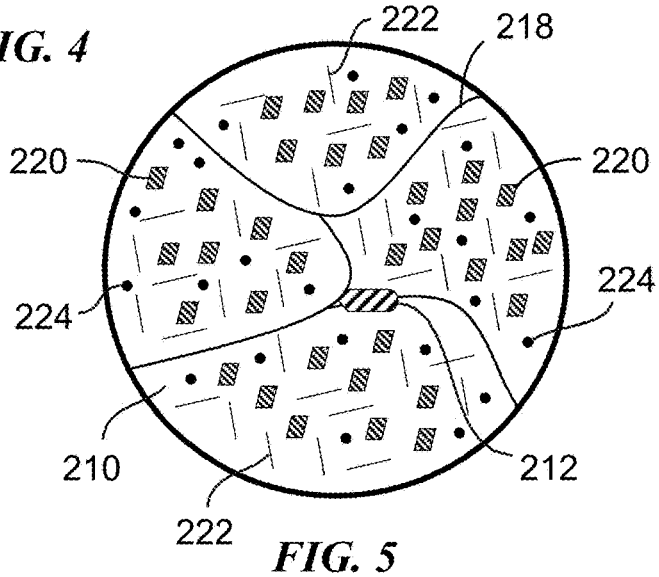
FIG. 5 is a schematic illustration of the microstructure of an Al—Si—Cr—Cu—Mg alloy that has been subjected to a heat treatment process, including a solution heat treatment stage and an aging heat treatment stage, the microstructure of the Al—Si—Cr—Cu—Mg alloy includes an aluminum matrix phase, an AlCrSi dispersoid phase, an AlCu precipitate phase, and an AlCuMgSi precipitate phase.

FIG. 5 is a schematic illustration of the microstructure of the Al—Si—Cr—Cu—Mg alloy after the Al—Si—Cr—Cu—Mg alloy is cooled in stage 160. The microstructure of the Al—Si—Cr—Cu—Mg alloy depicted in FIG. 5 is shown as if the alloy were being viewed along the $[001]_{Al}$ zone axis and may or may not be to scale. The morphology of the Al—Si—Cr—Cu—Mg alloy may appear somewhat different than that depicted in FIG. 5, for example, if the alloy were to be viewed along a different axis. As shown in FIG. 5, after the Al—Si—Cr—Cu—Mg alloy is cooled in stage 160, the alloy will comprise an aluminum matrix phase 210, an AlCrSi dispersoid phase 220, and one or more precipitate phases. For example, as shown in FIG. 5, the Al—Si—Cr—Cu—Mg alloy may comprise a AlCu precipitate phase 222 and an AlCuMgSi precipitate phase 224 dispersed throughout the aluminum matrix phase 210. The AlCu precipitate phase 222 may comprise a plurality of discrete plate-shaped precipitate grains and the AlCuMgSi precipitate phase 224 each may comprise a plurality of discrete lath-shaped precipitate grains, with the precipitate grains of each of the precipitate phases 222, 224 having mean grain diameters of less than 100 nm. The AlCu precipitate phase 222 may account for greater than 0 vol. % to about 5.0 vol. % of the Al—Si—Cr—Cu—Mg alloy, and the AlCuMgSi precipitate phase 224 may account for greater than 0 vol. % to about 3.0 vol. % of the Al—Si—Cr—Cu—Mg alloy. In some embodiments, one or more Cr-rich intermetallic phases 212 also may remain within the matrix phase 210. After the Al—Si—Cr—Cu—Mg alloy is cooled in stage 160, the alloy may exhibit a yield strength in the range of 250-350 MPa and a tensile strength in the range of 300-400 MPa at ambient temperature.

Figure 2:
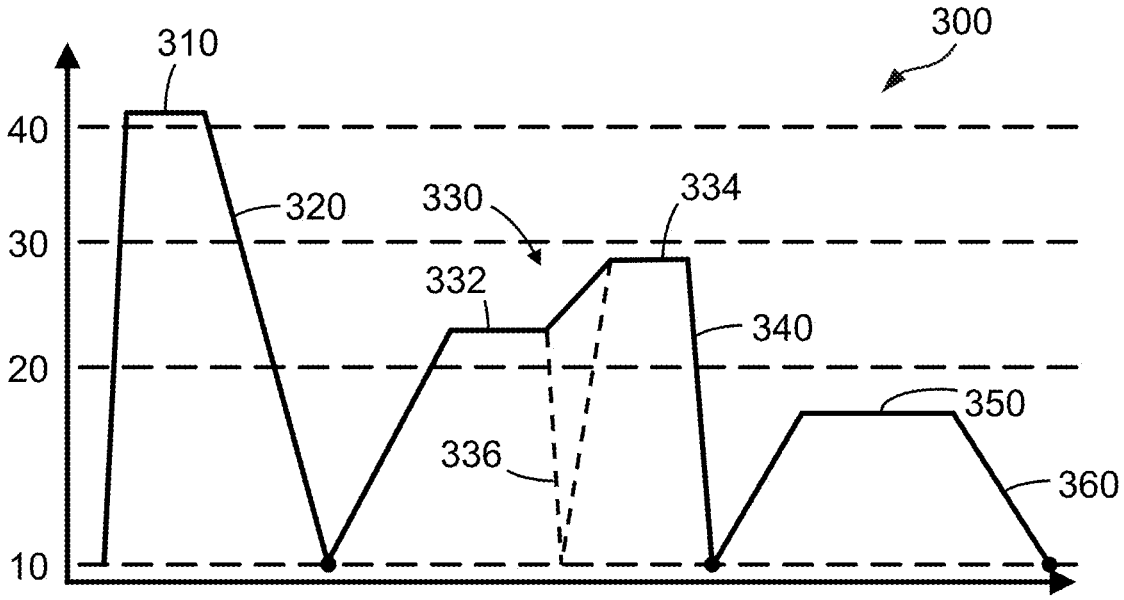
FIG. 2 is a schematic graph of Temperature vs. Time illustrating another multistage heat treatment process for manufacturing an Al—Si—Cr—Cu—Mg alloy having a dispersion strengthened and precipitation strengthened microstructure, in accordance with another aspect of the present disclosure.

FIG. 2 depicts a graph of processing temperature versus time for another multistage heat treatment process 300 that can be used to produce an Al—Si—Cr—Cu—Mg alloy exhibiting a dispersion strengthened and precipitation strengthened microstructure, according to another embodiment of the present disclosure. Like the process 100 described above with respect to FIG. 1, the heat treatment process 300 also may include one or more of the following stages: a casting stage 310, a first cooling stage 320, a solution heat treatment stage 330, a quenching stage 340, an aging heat treatment stage 350, and a second cooling stage 360. The details of stages 110, 120, 140, 150, and 160 described above with respect to FIG. 1 apply equally to stages 310, 320, 340, 350, and 360 depicted here in FIG. 2 and thus will not be repeated.

The solution heat treatment stage 330 depicted in FIG. 2 comprises two sub-stages: a first solution heat treatment sub-stage 332 and a second solution heat treatment sub-stage 334. After formation and solidification of the Al—Si—Cr—Cu—Mg alloy in the casting and cooling stages 310, 320, the Al—Si—Cr—Cu—Mg alloy may be heated in sub-stage 332 to a fourth temperature T4 below the solidus temperature $T_S$ of the Al—Si—Cr—Cu—Mg alloy, but above the solvus temperature $T_V$ of the one or more coarse intermetallic phases. For example, the Al—Si—Cr—Cu—Mg alloy suitably may be heated in sub-stage 332 to a fourth temperature T4 in the range of 150° C. to less than 500° C. for 1-10 hours. In one specific example, the Al—Si—Cr—Cu—Mg alloy suitably may be heated in sub-stage 332 to a fourth temperature T4 in the range of 300° C. to less than 500° C. for 1-10 hours. Thereafter, in sub-stage 334, the Al—Si—Cr—Cu—Mg alloy may be heated to a fifth temperature T5 above the fourth temperature T4, but below the solidus temperature $T_S$ of the Al—Si—Cr—Cu—Mg alloy. For example, the Al—Si—Cr—Cu—Mg alloy suitably may be heated in sub-stage 334 to a fifth temperature T5 in the range of 500° C. to 540° C. for 0.5-4 hours.

In some embodiments, the solution heat treatment stage 330 may include a quenching sub-stage 336 between sub-stages 332, 334. In sub-stage 336, the Al—Si—Cr—Cu—Mg alloy may be cooled or quenched from the fourth temperature T4 to ambient temperature $T_A$ or to an intermediate temperature. For example, the Al—Si—Cr—Cu—Mg alloy may be quenched after sub-stage 332 at a rate of greater than 1° C. per second by immersing the Al—Si—Cr—Cu—Mg alloy in a liquid medium, e.g., in water or oil. Thereafter, the Al—Si—Cr—Cu—Mg alloy may be reheated to the fifth temperature T5 for purposes of carrying out sub-stage 334.

After the Al—Si—Cr—Cu—Mg alloy has been subjected to the solution heat treatment stage 330, including sub-stages 332, 334 and optionally sub-stage 336, the Al—Si—Cr—Cu—Mg alloy may be quenched in stage 340. After the Al—Si—Cr—Cu—Mg alloy is quenched in stage 340, the alloy may exhibit substantially the same microstructure as that shown in FIG. 4.

After the Al—Si—Cr—Cu—Mg alloy has been quenched in stage 340, the Al—Si—Cr—Cu—Mg alloy may be artificially aged in stage 350 and then cooled in stage 360 to ambient temperature $T_A$ by any suitable method. After the Al—Si—Cr—Cu—Mg alloy is cooled in stage 360, the alloy may exhibit substantially the same microstructure as that shown in FIG. 5.

Experimental

An aluminum alloy comprising, by weight, 5% silicon, 0.27% chromium, 0.5% magnesium, 0.12% iron, 0.03% manganese, and the balance aluminum (Al—Si—Cr—Mg alloy) was prepared in a laboratory environment and allowed to gradually cool to room temperature. Thereafter, multiple samples of the Al—Si—Cr—Mg alloy were solution heat treated at a temperature of 540° C. for durations of 0, 5, 6, 12, and 20 hours, and then quenched to ambient temperature. No additional heat treatments were performed after the solution heat treatment. The Al—Si—Cr—Mg alloy had a Cr:(Fe+Mn) weight ratio of ~1.8 and a sludge factor (SF) of about 0.99. This exemplary Al—Si—Cr—Mg alloy was prepared without addition of Cu for purposes of illustrating the features and isolated benefits of the AlCrSi dispersoid phase, without influence of one or more Cu-containing precipitate phases that otherwise may have formed in the alloy.

The microstructure of the Al—Si—Cr—Mg alloy sample that was solution heat treated at a temperature of 540° C. for 5 hours was observed using scanning transmission electron microscopy (STEM), with elemental mapping of Cr, Si, Fe, and Mn performed using energy-dispersive x-ray spectroscopy (EDX).

As shown in FIGS. 6 and 7, the Al—Si—Cr—Mg alloy sample that was solution heat treated at a temperature of 540° C. for 5 hours includes several AlCrSi dispersoid grains 420 and a relatively small number of Al(Mn,Fe,Cr)Si dispersoid grains 430 distributed throughout the aluminum matrix phase 410. The AlCrSi dispersoid grains 420 exhibited grain diameters ranging in size from about 20 nm to about 100 nm, with a mean grain diameter of about 50 nm. On the other hand, the Al(Mn,Fe,Cr)Si dispersoid grains 430 were substantially larger and exhibited grain diameters ranging in size from about 50 nm to about 200 nm, with a mean grain diameter of about 100 nm.

Figure 8:
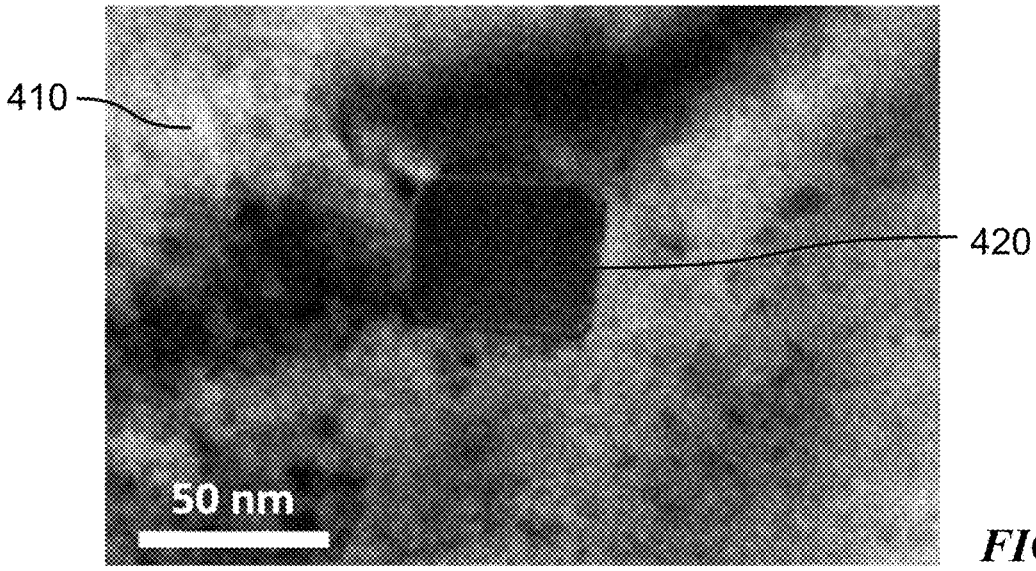
FIG. 8 is a scanning transmission electron microscopy (STEM) image of a portion of a solution heat treated Al—Si—Cr—Mg alloy depicting a single AlCrSi dispersoid within an aluminum matrix phase.
Figure 9:
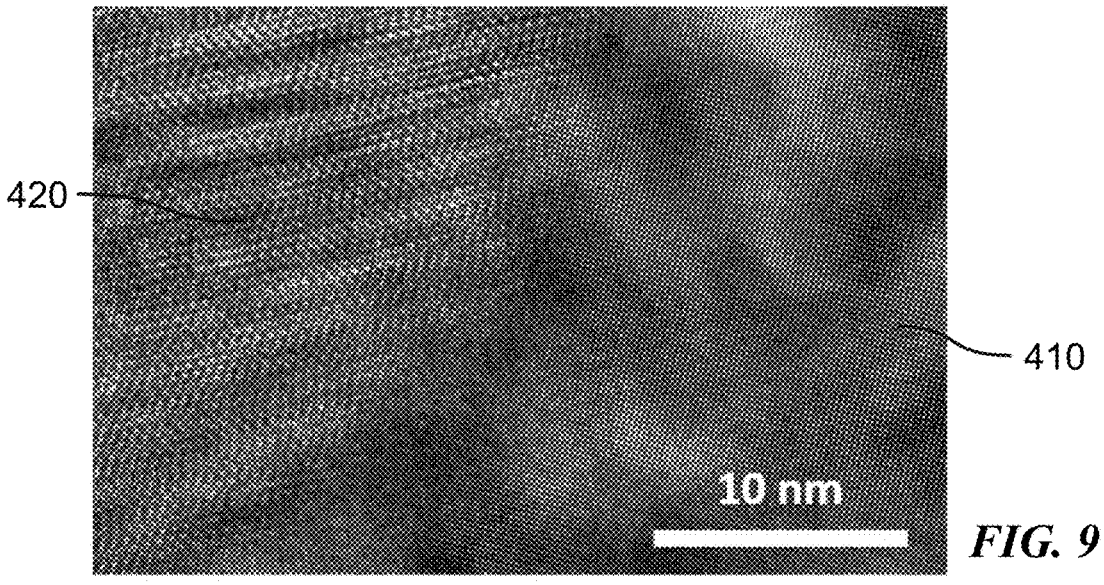
FIG. 9 is an enlarged view of the STEM image of FIG. 8 illustrating the interface between the crystal lattice of the AlCrSi dispersoid and the crystal lattice of the aluminum matrix phase.
Figure 10:
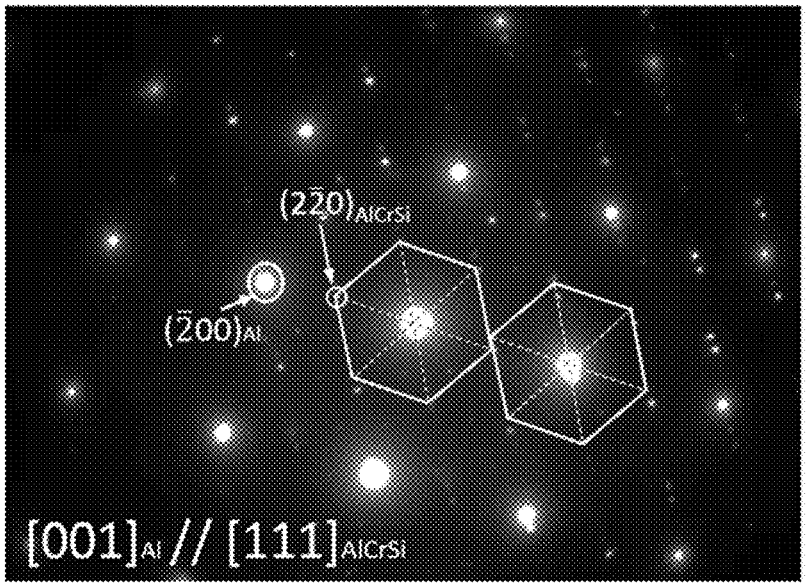
FIG. 10 is an electron beam diffraction pattern of the interface between the crystal lattice of the AlCrSi dispersoid and the crystal lattice of the aluminum matrix phase of FIG. 9.

As shown in FIGS. 8, 9, and 10, the crystal lattice parameters of the AlCrSi dispersoid grains 420 exhibit an orientation and dimensional relationship with the aluminum matrix phase 410.

Figure 11:
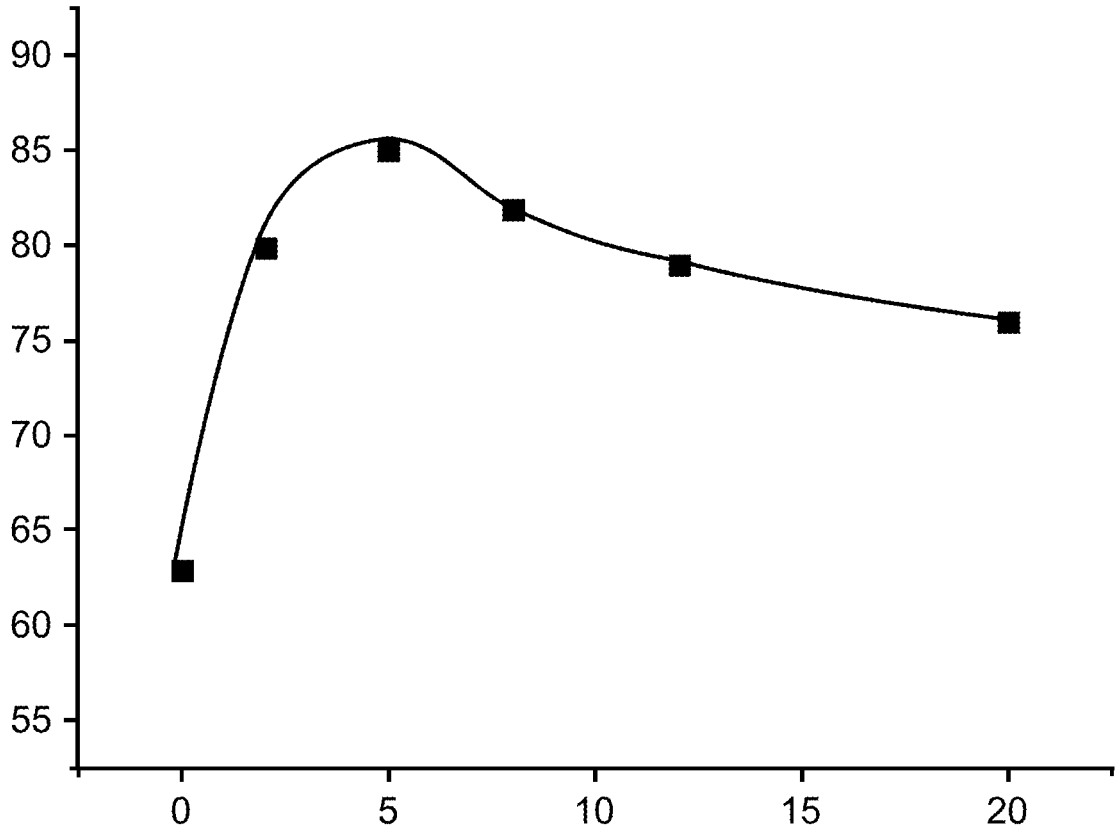
FIG. 11 is a chart of Vickers Hardness (HV) vs. Solution Heat Treatment Duration (hours) for an Al—Si—Cr—Mg alloy.

The Vickers hardness of the Al—Si—Cr—Mg alloy samples was measured after they were solution heat treated using a BUEHLER VH3300 hardness tester with a load of 200 grams and a loading time of 10 seconds. FIG. 11 illustrates the Vickers hardness of the Al—Si—Cr—Mg alloy samples as a function of the solution heat treatment duration (hours). As shown, solution heat treatment effectively increases the Vickers hardness of the Al—Si—Cr—Mg alloy, with the Al—Si—Cr—Mg alloy experiencing a peak in hardness of about 85 HV0.2 after being solution heat treated for a duration of about 5 hours.

The thermal stability of the Al—Si—Cr—Mg alloy sample that was solution heat treated at a temperature of 540° C. for 5 hours was evaluated by subjecting the sample to a thermal conditioning treatment, wherein the Al—Si—Cr—Mg alloy sample was heated at a temperature of 300° C. for about 100 hours. For comparison, another aluminum alloy sample comprising, by weight, 5% silicon, 0.5% magnesium, 0.15% iron, 0.07% manganese, and the balance aluminum (Al—Si—Mg alloy) was prepared in a laboratory environment, solution heat treated at a temperature of 540° C. for 5 hours, quenched to ambient temperature, and then heated at a temperature of 300° C. for about 100 hours.

After thermal conditioning, the Al—Si—Cr—Mg alloy sample exhibited a Vickers hardness of about 44 HV0.025, but the Al—Si—Mg alloy sample only exhibited a Vickers hardness of about 36 HV0.025, indicating that the AlCrSi dispersoid phase is thermally stable and that the thermal stability of an Al alloy can be improved by addition of suitable amounts of Cr and formation of an AlCrSi dispersoid phase therein.

The above description of preferred exemplary embodiments, aspects, and specific examples are merely descriptive in nature; they are not intended to limit the scope of the claims that follow. Each of the terms used in the appended claims should be given its ordinary and customary meaning unless specifically and unambiguously stated otherwise in the specification.

What is claimed is:

1. An aluminum alloy for casting shaped aluminum alloy parts, the aluminum alloy comprising, by weight, 3-11% silicon (Si), 0.1-0.6% chromium (Cr), ≤0.15% iron (Fe), and ≤0.3% manganese (Mn), and wherein a weight ratio of chromium to iron and manganese, Cr:(Fe+Mn), in the aluminum alloy is greater than or equal to 1:1.

2. The aluminum alloy set forth in claim 1 wherein, after the aluminum alloy is solution heat treated, the aluminum alloy exhibits a multiphase microstructure including an aluminum matrix phase and a fine-grained AlCrSi dispersoid phase, and wherein the AlCrSi dispersoid phase exhibits a face centered cubic (fcc) crystal lattice structure and comprises, by weight, greater than 80% Al, Cr, and Si.

3. The aluminum alloy set forth in claim 2 wherein the AlCrSi dispersoid phase and the aluminum matrix phase exhibit a crystallographic orientation relationship between adjacent crystal grains, and wherein the crystallographic orientation relationship between the adjacent crystal grains is at least one of $<001>_{Al}//<111>_{AlCrSi}$, $\{200\}_{Al}//\{4\bar{4}0\}_{AlCrSi}$ or $<001>_{Al}//<1\bar{1}0>_{AlCrSi}$, $\{200\}_{Al}//\{333\}_{AlCrSi}$.

4. The aluminum alloy set forth in claim 2 wherein the AlCrSi dispersoid phase comprises a plurality of AlCrSi dispersoid grains distributed throughout the aluminum matrix phase, and wherein the AlCrSi dispersoid grains have a mean grain diameter of less than or equal to 70 nm.

5. The aluminum alloy set forth in claim 2 wherein the AlCrSi dispersoid phase accounts for 0.3-2.0 vol. % of the aluminum alloy.

6. The aluminum alloy set forth in claim 2 wherein, after the aluminum alloy is solution heat treated, the multiphase microstructure of the aluminum alloy also includes an Al(Mn,Fe,Cr)Si dispersoid phase, and wherein the Al(Mn,Fe,Cr)Si dispersoid phase accounts for less than 0.2 vol. % of the aluminum alloy.

7. The aluminum alloy set forth in claim 1 comprising, by weight, 0.1-5% copper (Cu) and 0.1-1% magnesium (Mg), and wherein, after the aluminum alloy is solution heat treated and artificially aged, the aluminum alloy exhibits a multiphase microstructure including an aluminum matrix phase, a fine-grained AlCrSi dispersoid phase, and one or more Cu-containing precipitate phases.

8. The aluminum alloy set forth in claim 7 wherein the one or more Cu-containing precipitate phases include at least one of an AlCu precipitate phase and an AlCuMgSi precipitate phase.

9. The aluminum alloy set forth in claim 1 comprising, by weight: 5-9% silicon, 0.2-0.5% chromium, 0.3-1% copper, 0.3-0.5% magnesium, 0.05-0.2% titanium, 0.01-0.02% strontium, and aluminum as balance.

* * * * *